US005568230A

United States Patent [19]

Reddy et al.

[11] Patent Number: 5,568,230

[45] Date of Patent: Oct. 22, 1996

[54] REPLACEABLE OZONE ABSORBING SUBSTRATES FOR A PHOTOCOPYING DEVICE

[75] Inventors: Karimireddy H. Reddy, Rochester; Alan M. Litman, Webster, both of N.Y.

[73] Assignee: Xerox Corporation, Stamford, Conn.

[21] Appl. No.: 383,347

[22] Filed: Feb. 3, 1995

[51] Int. Cl.[6] ..... G03G 21/00

[52] U.S. Cl. ..... 355/215; 355/219; 355/221

[58] Field of Search ..... 355/215, 219, 355/221

[56] References Cited

U.S. PATENT DOCUMENTS

| | | | |
|---|---|---|---|
| 4,315,837 | 2/1982 | Rourke et al. | 252/430 |
| 4,388,274 | 6/1983 | Rourke et al. | 422/177 |
| 4,466,813 | 8/1984 | Avritt et al. | 355/215 X |
| 4,585,320 | 4/1986 | Altavela et al. | 355/221 X |
| 4,585,323 | 4/1986 | Ewing et al. | 355/221 X |
| 4,680,040 | 7/1987 | Gooray et al. | 55/387 |
| 4,792,680 | 12/1988 | Lang et al. | 250/325 |
| 4,853,735 | 8/1989 | Kodama et al. | 355/215 |
| 4,920,266 | 4/1990 | Reale | 250/324 |
| 5,142,328 | 8/1992 | Yoshida | 355/215 |
| 5,257,073 | 10/1993 | Gross et al. | 355/221 |
| 5,371,577 | 12/1994 | Fujimura et al. | 355/215 |
| 5,485,253 | 1/1996 | Osbourne | 355/221 |

*Primary Examiner*—Fred L. Braun
*Attorney, Agent, or Firm*—John S. Wagley

[57] ABSTRACT

A corona generator including a support structure and an electrode mounted on the support structure is provided. The corona generator also includes an ozone neutralizing element removably mounted on the support structure proximate to the electrode. The ozone neutralizing element has various substrates and types for removably mounting the element.

8 Claims, 7 Drawing Sheets

36
C
44
42
B
26
M
28
32
16
18
34
25
24
27
22
30
A
74
F
58
72
60
D
62
64
66
68
E

REPLACEABLE OZONE ABSORBING SUBSTRATES FOR A PHOTOCOPYING DEVICE

The present invention relates to a method and apparatus for removing ozone. More specifically, the invention relates to an ozone removing material.

Cross reference is made to the following application filed concurrently herewith: U.S. application Ser. No. 08/383,166, filed Feb. 3, 1995, entitled "Replaceable Nitrous Oxide Removing Substrates", by A. M. Litman et al.

In the well-known process of electrophotographic printing, the photoconductive member is electrostatically charged, and then exposed to a light pattern of an original image to selectively discharge the surface in accordance therewith. The resulting pattern of charged and discharged areas on the photoconductive member forms an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the photoconductive member is cleaned from the surface thereof. The process is useful for light lens copying from an original or printing electronically generated or stored originals such as with a raster output scanner (ROS), where a charged surface may be imagewise discharged in a variety of ways.

Various types of charging devices have been used to charge or precharge photoconductive insulating layers. In commercial use, for example, are various types of corona generating devices to which a high voltage of 5,000 to 8,000 volts may be applied to the corotron device thereby producing a corona spray which imparts electrostatic charge to the surface of the photoreceptor. One particular device would take the form of a single corona wire strung between insulating end blocks mounted on either end of a channel or shield. Another device which is used to provide more uniform charging and to prevent overcharging, is a scorotron which includes two or more corotron wires with a control grid or screen of parallel wires or apertures in a plane positioned between the corona wires and the photoconductor. A potential is applied to the control grid of the same polarity as the corona potential but with a much lower voltage, usually several hundred volts,which suppressed the electric field between the charge plate and the corona wires and markedly reduces the ion current flow to the photoreceptor.

A recently developed corona charged device is described in U.S. Pat. No. 4,086,650 to Davis et al., commonly referred to as a dicorotron. The corona discharge electrode is coated with a relatively thick dielectric material, such as glass, to substantially prevent the flow of conduction current therethrough. The delivery of charge to the photoconductive surface is accomplished by a displacement current or capacitive coupling through the dielectric material. The flow of charge to the surface is to be charged is regulated by a DC bias applied to the corona shield. In operation an AC potential of from about 5,000 to 7,000 volts at a frequency of about 4 KHz produces a true corona current, an ion current of 1 to 2 milliamps. This device has the advantage of providing a uniform negative charge to the photoreceptor. In addition, it is a relatively low maintenance charging device in that it is the least sensitive of the charging devices to contamination by dirt and requires less cleaning.

In the dicorotron device described above the dielectric coated corona discharge electrode is a coated wire supported between insulating end blocks and the device has a conductive auxiliary DC electrode positioned opposite to the image surface in which the charge is to be placed. In the conventional corona discharge device, the conductive corona electrode is also in the form of an elongated wire connected to a corona generating power supply and supported by end blocks with the wire being partially surrounded by a conductive shield which is usually grounded. The surface to be charged is spaced from the wire on the side opposite the shield and is mounted on a conductive substrate.

In addition to the desirability to negatively charge one type of photoreceptor, it is often desired to provide a negative precharge to another type photoreceptor such as a selenium alloy prior to its actually being positively charged. A negative precharging is used to neutralize the positive charge remaining on the photoreceptor after transfer of the developed toner image to the copy sheet and cleaning to prepare the photoreceptor for the next copying cycle. Typically in such a precharge corotron an AC potential of between 4,500 and 6,000 volts rms at 400 to 600 Hz may be applied.

Certain difficulties have been observed when using corona charge devices that produce a negative corona. It is known that in the operation of the corona generators in an electrostatographic copy machine the corona generators generate various noxious gases including ozone. It is also known that the problem of the formation of ozone during the operation of corona generators is more acute at higher levels of output of corona charging. Increased copy speeds as well as other requirements placed on modern copy machines have resulted in needs for higher outputs from corona devices.

The detrimental effects of ozone on machine components and people is well known. Ozone may detrimentally affect the performance of the photosensitive member in copy machines. Further any hydrocarbon material is susceptible to hydrogen embrittlement from the exposure to ozone. Also, ozone is very corrosive and may accelerate oxidation.

Relatively low concentrations of ozone in the atmosphere, for example, from 1 part per 1,000,000 to 10 parts per million, can cause headaches, nausea and irritation of mucous membranes. Heavier levels of ozone cause progressively more severe respiratory problems.

The United States has passed various regulations under the Occupational Safety and Health Administration, OSHA, limiting the emissions of ozone from industrial equipment, including electrostatographic copy machines.

Certain materials have been found to be somewhat effective in removing or decomposing ozone, these material include: oxides of manganese, vanadium, iron, copper, nickel, chromium, cobalt, the salts of these metals, and catalysts including these metals. Activated carbon is also effective and may be coated with palladium, platinum or silver.

The manufacturing of substrates with the activated carbon with palladium, platinum or silver applied thereto is expensive. The carbon is preferably applied to a flat metallic planar surface of the element which is later formed into its final shape. The carbon is fragile and may be damaged in the forming process and in the assembly of the corona generating device. Furthermore, over time the carbon is saturated with the ozone and the element on which the carbon is bonded must be replaced. This replacement is difficult and expensive.

The following disclosures may be relevant to various aspects of the present invention:

U.S. Pat. No. 5,257,073

Patentee: Gross, et al.

Issue Date: Oct. 26, 1993

U.S. Pat. No. 4,920,266

Patentee: Reale

Issue Date: Apr. 24, 1990

U.S. Pat. No. 4,853,735

Patentee: Kodama et al.

Issue Date: Aug. 1, 1989

U.S. Pat. No. 4,792,680

Patentee: Lang et al.

Issue Date: Dec. 20, 1988

U.S. Pat. No. 4,680,040

Patentee: Gooray et al.

Issue Date: Jul. 14, 1987

U.S. Pat. No. 4,388,274

Patentee: Rourke et al.

Issue Date: Jun. 14, 1983

U.S. Pat. No. 4,315,837

Patentee: Rourke et al

Issue Date: Feb. 16, 1982

U.S. Pat. No. 5,257,073 discloses a corona generating device of the type in which a control screen adjacent a corona generating electrode regulates the charge flow. The control screen is coated with a substantially continuous layer of boron electroless nickel. The nickel serves to extend the effective life of the device by preventing line image deletions.

U.S. Pat. No. 4,920,226 discloses a corona generating device for depositing negative charge on an imaging surface. The device includes at least one element adjacent the corona discharge electrode capable of absorbing nitrogen oxide species generated when the electrode is energized and capable of desorbing the nitrogen oxide species once the electrode is not energized. The element is coated with a thin conductive dry film of aluminum hydroxide containing graphite and powdered nickel.

U.S. Pat. No. 4,853,735 discloses an ozone removing device for use in a copier. The device includes a container for containing a quantity of volatile ozone removing agent. The vaporized ozone removing agent flows out of the container and diffuses into the surrounding atmosphere where it decomposes and removes the ozone when encountered. A filter including holes in the mouth of the container regulates the dispersion of agent from the container.

U.S. Pat. No. 4,792,680 discloses a scorotron screen for use in a negative corona charging device. The device includes a beryllium copper alloy which reduces the problems associated with line image deletions.

U.S. Pat. No. 4,680,040 discloses a filtering material for use in an electrostatographic reproducing machine. The material has a support matrix having a plurality of voids to permit flow of gaseous material therethrough while trapping particulate material. The material may be placed in the air stream of the machine to neutralize ozone generated by a corona discharge device.

U.S. Pat. No. 4,388,274 discloses an apparatus for the collection and removal of ozone from a copy machine. The machine includes an apertured plenum at the point of ozone generation. The air in the plenum is passed through a cone shaped filter made of a foraminous screen of an ozone decomposing material such as Hopcalite.

U.S. Pat. No. 4,315,837 discloses a composite material for the removal of ozone from a stream. The material is made of a support matrix of polymeric ethyl vinylacetate coated with a layer of fine particles of Hopcalite.

SUMMARY OF THE INVENTION

In accordance with one aspect of the present invention, there is provided a corona generator including a support structure and an electrode mounted on the support structure. The corona generator also includes an ozone neutralizing element removably mounted on the support structure proximate to the electrode.

In accordance with another aspect of the present invention, there is provided a printing machine of the type having a corona generating device for charging a surface. The printing machine includes a support structure and an electrode mounted on the support structure. The printing machine also includes an ozone neutralizing element removably mounted on the support structure proximate to the electrode.

BRIEF DESCRIPTION OF THE DRAWINGS

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 9:
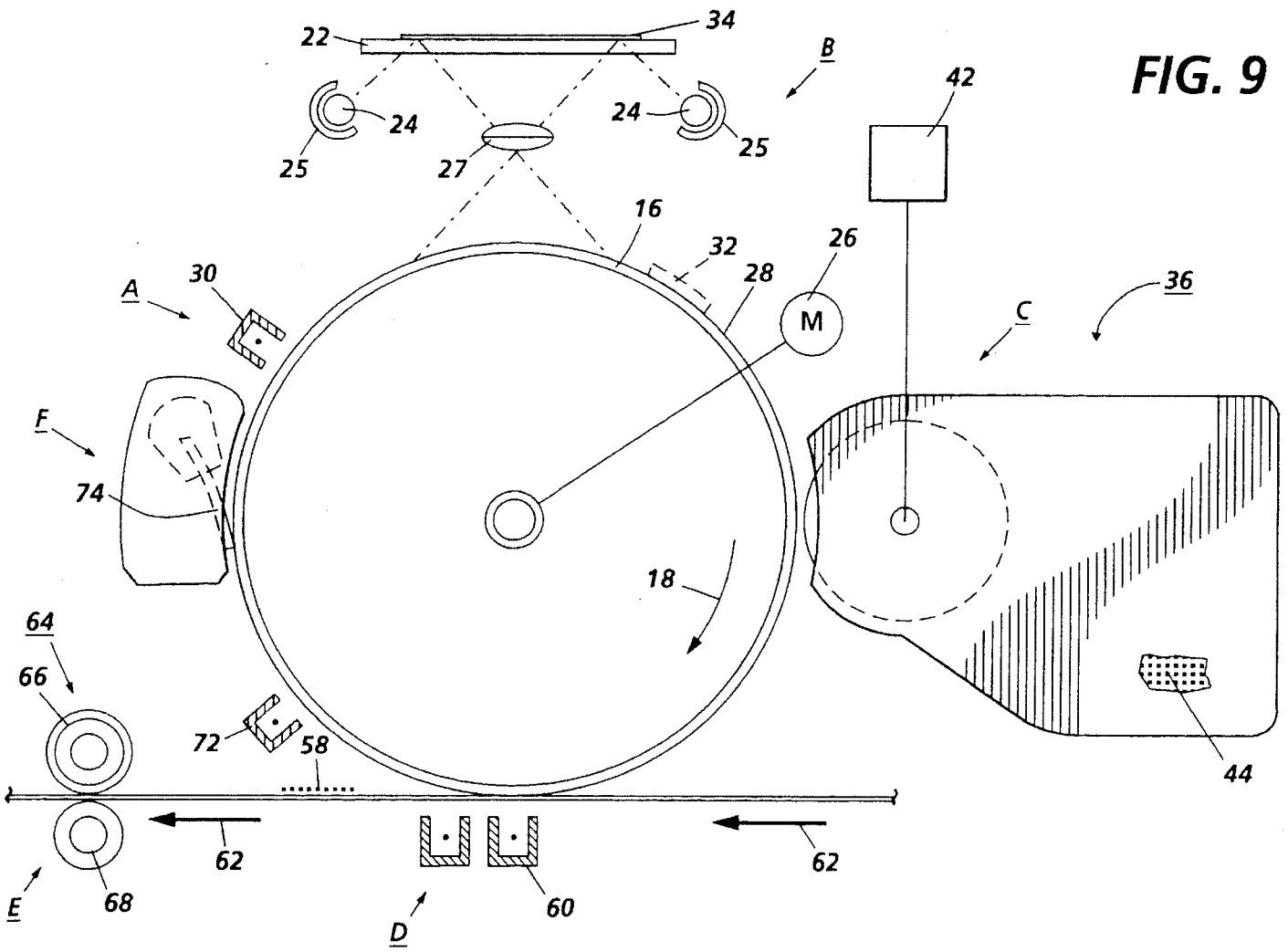
FIG. 9 is a schematic elevational view of an illustrative electrophotographic printing machine incorporating the corona discharge device of the present invention therein.

For a general understanding of the illustrative electrophotographic printing machine incorporating the features of the present invention therein, reference is made to the drawings. In the drawings, like reference numerals have been used throughout to designate identical elements. FIG. 9 schematically depicts the various components of an electrophotographic printing machine incorporating the corona discharge device of the present invention therein. Although the corona discharge device of the present invention is particularly well adapted for use in the illustrative printing machine, it will become evident that these corona discharge devices are equally well suited for use in a wide variety of uses and are not necessarily limited in their application to the particular embodiments shown herein.

Referring now to FIG. 9, the electrophotographic printing machine shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 26 rotates drum 16 to advance drum 16 in the direction of arrow 18. Drum 16 is coupled to motor 26, by suitable means such as a drive.

Initially successive portions of drum 16 pass through charging station A. At charging station A, a corona generating device, indicated generally by the reference numeral 30, charges the drum 16 to a selectively high uniform electrical potential. The electrical potential is normally opposite in sign to the charge of the toner. Depending on the toner chemical composition, the potential may be positive or negative. Any suitable control, well known in the art, may be employed for controlling the corona generating device 30.

A document 34 to be reproduced is placed on a platen 22, located at imaging station B, where it is illuminated in a known manner by a light source such as a lamp 24 with a photo spectral output matching the photo spectral sensitivity of the photoconductor. The document thus exposed is imaged onto the drum 16 by a system of mirrors 25 and lens 27, as shown. The optical image selectively discharges surface 28 of the drum 16 in an image configuration whereby an electrostatic latent image 32 of the original document is recorded on the drum 16 at the imaging station B.

At development station C, a development system or unit, indicated generally by the reference numeral 36 advances developer materials into contact with the electrostatic latent images. The developer unit 36 includes a device to advance developer material into contact with the latent image.

The developer unit 36, in the direction of movement of drum 16 as indicated by arrow 18, develops the charged image areas of the photoconductive surface 28. This developer unit contains black developer, for example, material 44 having a triboelectric charge such that the black toner is urged towards charged areas of the latent image by the electrostatic field existing between the photoconductive surface and the electrically biased developer rolls in the developer unit which are connected to bias power supply 42.

A sheet of support material 58 is moved into contact with the toner image at transfer station D. The sheet of support material 58 is advanced to transfer station D by conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, binding, inverting and returning the sheet for duplexing and the like.

After the sheet of support material is separated from the photoconductive surface of drum 16, the residual toner particles carried by image and the non-image areas on the photoconductive surface are removed at cleaning station F. The cleaning station F includes a blade 74.

It is believed that the foregoing description is sufficient for purposes of the present application to illustrate the general operation of an electrophotographic printing machine incorporating the development apparatus of the present invention therein.

Figure 1:
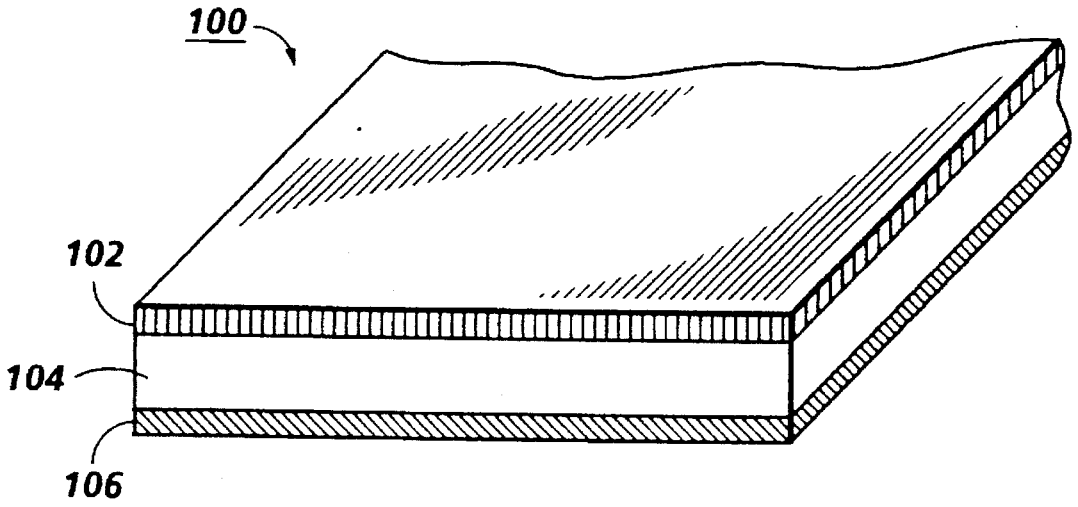
FIG. 1 is a partial perspective view of removable ozone absorbing element according to the present invention.

Referring initially to FIG. 1, an ozone neutralizing system 100 is shown. The system 100 includes an ozone neutralizing layer 102 which may be placed on the surface (not shown) of member (not shown) near an ozone emitting source or emitter (not shown). The layer 102 may consist of any material or materials capable of adsorbing ozone generated when the ozone emitter is energized and capable of desorbing ozone when the ozone emitter is not energized so as to neutralize ozone emitted from the ozone emitter. The neutralizing layer 102 is removably securable to the surface of the member near the emitter. The removably securable feature can be accomplished by any suitable means such as by hooks, tabs or detents in either or both of the layer or the surface of the member. To assist in providing the removably securable feature, the neutralizing layer 102 is preferably secured to a substrate 104. The substrate 104 provides a durable structure that may be secured to the surface of the member by the hooks, tabs, glue or detents in either or both of the layer or the surface of the member. The substrate 104 may be made of any suitable durable material such as plastic, paper or metal. While the substrate 104 may be secured by detents etc., the substrate is preferably secured to the surface of the member by an adhesive layer 106 applied to the substrate 104 on the surface of the substrate 104 opposed to the neutralizing layer 102. The adhesive layer may be made of any suitable adhesive that provides for the removable feature. The neutralizing layer 102 may be applied to the substrate 104 by any suitable process such as laminating, weaving, web processing, screen printing, pad printing, spraying or roll coating. The system 100 may be in the form of strips which may be die cut into the appropriate shape to conform to the surface of the member. If the substrate 104 includes the adhesive layer 106, the strips 100 would be applied to the member in a fashion similar to applying a label. If no adhesive were used, the strips 100 could be snapped into a detent or bent into a self supporting structure.

Referring once again to FIG. 1, the ozone neutralizing layer 102 preferably is in the form of a substantially continuous thin coating of granular or powdery activated carbon. The activated carbon may include an oxide or salt of Mn, V, Fe, Cu, Ni, Cr, Co, or Zn which serves as a catalyst. Other catalysts include Pd or Ag. The activated carbon neutralizes the ozone that may be generated when a dicorotron is energized. It should be appreciated that the layer 102 may likewise be in the form of a pattern, such as a series of characters or a geometric pattern, for example a series of dots. Such a film is commercially available. It should be appreciated that the ozone neutralizing layer 102 may alternatively be made of any material capable of neutralizing ozone. The neutralizing ozone media may alternatively be impregnated into a non-woven polyester fiber activated with carbon. Also, for example, the neutralizing ozone layer or media may be composite material including a support matrix having coated on its surface a layer of a porous ceramic material of about 80% manganese oxide and about 20% cupric oxide. Such a material is commercially available as Hopcalite, a product of Mine Safety Appliances Corporation.

The exact mechanism by which the activated carbon neutralizes the ozone is not fully understood, but may be best described by the following equation.

$$3C+2O_3 \rightarrow 3CO_2$$

The carbon film should be sufficiently thick that it will not be consumed in a reasonable period of time thereby limiting the operation of the device. Accordingly, it is preferred that the carbon film be at least 5 microns in thickness to provide an acceptable operational life. Typically films are deposited in a thickness up to about a mil or more to ensure that ozone is adsorbed and subsequently desorbed by the shield. The carbon film should be substantially continuous without pores.

Figure 2:
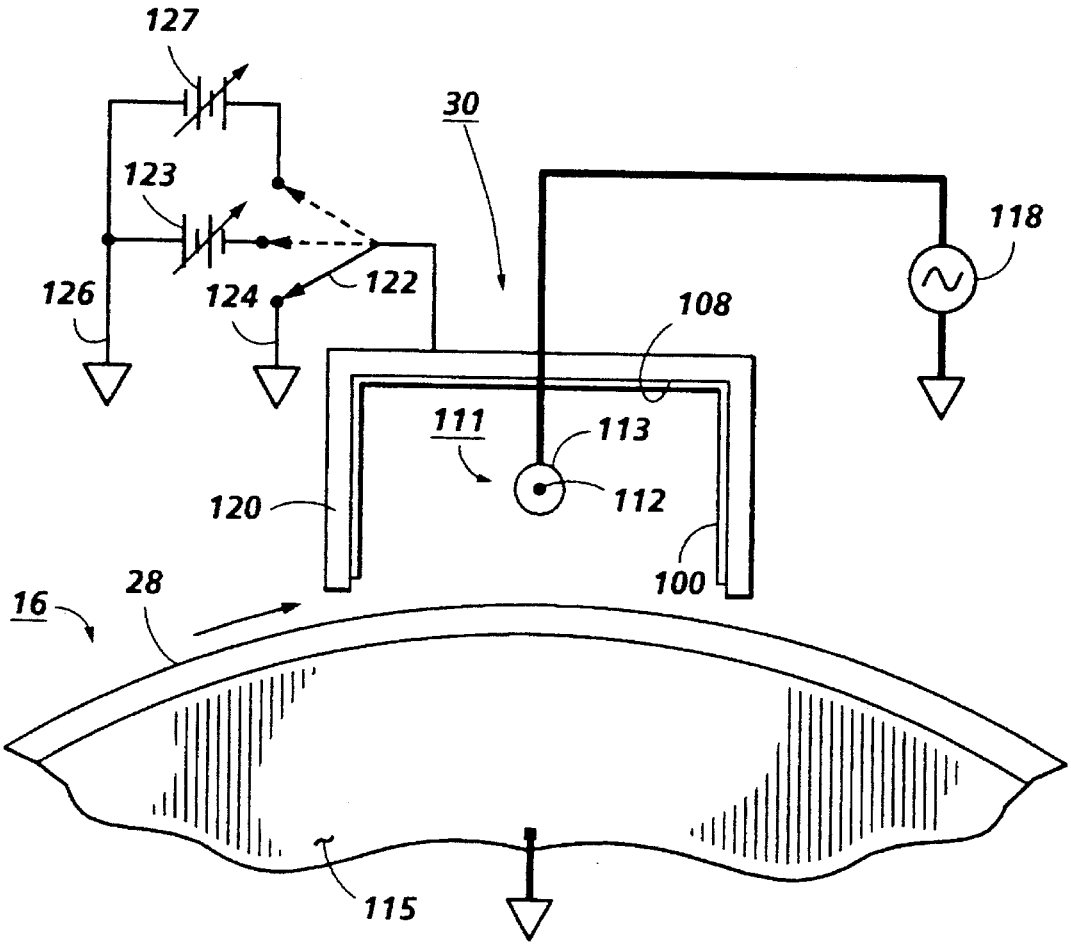
FIG. 2 is an illustrative schematic view partially in section of a corona discharge device according to the present invention.

Referring now to FIG. 2 the ozone emitter commonly found in an electrostatic printing machine of FIG. 9 is in the form of corona generator 30. The corona generator 30 of this invention is seen to comprise a corona discharge electrode 111 in the form of a conductive wire 112 having a relatively thick coating 113 of dielectric material.

The charge collecting surface 28 as shown may be a photoconductive surface in a conventional xerographic system. The charge collecting surface 28 is carried on a conductive substrate 115 of photoconductive drum 16 held at a reference potential, usually machine ground. An AC voltage source 118 is connected between the substrate 115 and the conductive wire 112, the magnitude of the AC source being selected to generate a corona discharge adjacent the wire 112. The member including the surface for adhering the strip 100 thereto which is adjacent the ozone emitter is in the form of a conductive shield 120. The shield 120 is located adjacent to the conductive wire 112 on the side of the wire opposite the charge collecting surface 28. The strip 100 is removably secured to a surface 108 of the shield 120.

The shield 120 has coupled thereto a switch 122 which depending on its position, permits the corona device to be operated in either a charge neutralizing mode or a charge deposition mode. With the switch 122 as shown, the shield 120 of the corona device is coupled to ground via a lead 124. In this position, no DC field is generated between the shield 120 and the substrate 115 and the corona device operates to neutralize over a number of AC cycles any charge present on the surface 28.

With switch 122 in either of the positions shown by dotted lines, the shield is coupled to one terminal of either DC sources 123 or 127. The other terminals of the sources are coupled by lead 126 to ground thereby establish a DC field between the surface 28 and the shield 120. In this position, the corona operates to deposit a net charge onto the surface 28. The polarity and magnitude of this charge depends on the polarity and magnitude of the DC bias applied to the shield 120.

The corona electrode 111 may be supported in conventional fashion at the ends thereof by insulating end blocks (not shown) mounted within the ends of shield 120. The wire 112 may be made of any conventional conductive filament material such as stainless steel, gold, aluminum, copper, tungsten, platinum or the like. The diameter of the wire is not critical and may vary typically between 0.5–15 mil. and preferably is about 9 mils.

Any suitable dielectric material may be employed as the coating 113 which will not break down under the applied corona AC voltage and which will withstand chemical attack under the conditions present in a corona device. Inorganic dielectrics have been found to perform more satisfactorily than organic dielectrics due to their higher voltage breakdown properties, and greater resistance to chemical reaction in the corona environment.

The thickness of the dielectric coating 113 used in the corona device of the invention is such that substantially no conduction current or DC charging current is permitted therethrough. Typically, the thickness is such that the combined wire and dielectric thickness falls in the range from 7–30 mil with typical dielectric thickness of 2–10 mil. Glasses with dielectric breakdown strengths above 2 KV/mil at 4 KHz and in the range of 2 to 5 mil thickness have been found by experiment to perform satisfactorily as the dielectric coating material. As the frequency or thickness goes down, the strength in volts will usually increase. The glass coating selected should be free of voids and inclusions and should make good contact with the wire on which it is deposited. Other possible coatings are ceramic materials such as Alumina Zirconia, Boron Nitride, Beryllium Oxide and Silicon Nitride. Organic dielectrics which are sufficiently stable in corona may also be used.

The frequency of the AC source 118 may be varied widely from about 60 Hz. to several megahertz. The device has been operated and tested at 4 KHz. and found to operate satisfactorily.

The shield 120 is shown as being rectangular in shape but any of the conventional shapes used for corona shields in xerographic charging may be employed. In fact, the function of the shield 120 may be performed by any conductive member, for example, a base wire, in the vicinity of the wire, the precise location not being critical in order to obtain satisfactory operation of the device.

With the switch 122 connected as shown so that the shield 120 is grounded, the device operates to inherently neutralize any charge present on the surface 28. This is a result of the fact that no net DC charging current passes through the electrode 111 by virtue of the thick dielectric coating 113 and the wire 112.

Referring to FIG. 2, the operation of the corona device of the present invention to deposit a specific net charge on an imaging surface is accomplished by moving switch 122 to one of the positions shown in dotted lines, whereby a DC potential of either positive or negative polarity with respect to the substrate 115 may be applied to the shield.

During charging, typical AC voltages applied to the corona electrodes are in the range from 4 KV to 7 KV at a frequency between 1 KHz and 10 KHz. With the conductive substrate of the imaging member being held at ground potential a negative DC bias of from about 800 volts to about 4 KV is applied to the shield. For further details of the manner of operation of the above described dicorotron device, attention is directed to U.S. Pat. No. 4,086,650 to Davis et al which is hereby incorporated by reference.

Figure 3:
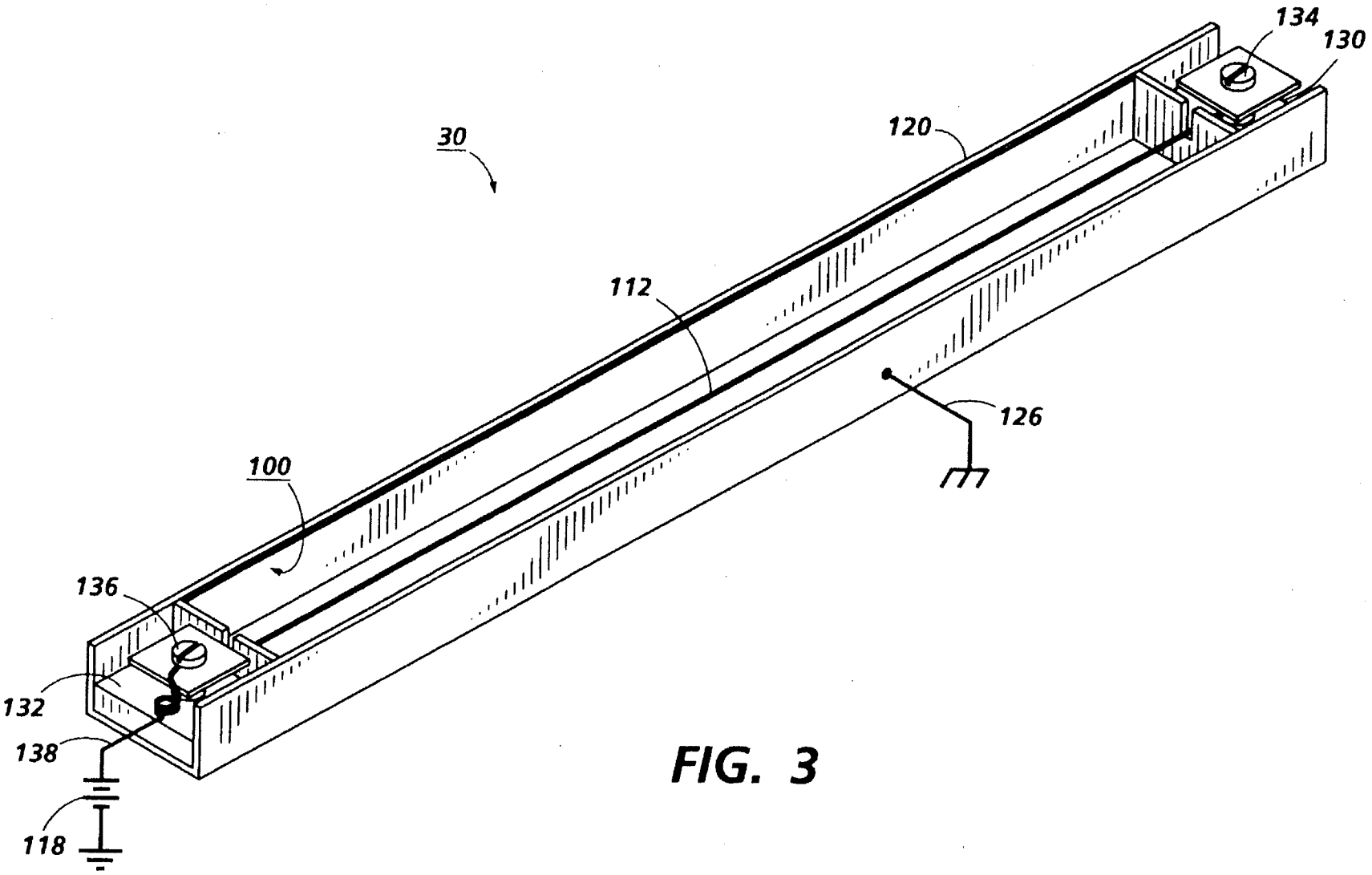
FIG. 3 is a perspective view of a corona discharge device according to the present invention.

Now referring to FIG. 3, the corona generating device 30 according to the present invention is shown in greater detail. The wire 112 is supported between insulating end block assemblies 130 and 132. The conductive corotron shield 120 which is grounded increases the ion density available for conduction. Since no charge builds up on the shield, the voltage between the shield and the wire remain constant and a constant density of ions is generated by the wire. The effect of the grounded shield is to increase the amount of current flowing. The corona wire 112 at one end is fastened to port 134 in the first end block assembly 130 and at the other end is fastened to port 136 of the second end block assembly 132. The wire 112 at the second end of the corona generating device is connected to the corona potential generating source 118 by lead 138. Such a device might have utility as an AC precharge corona generating device in which case the corotron shield 120 is coated with an ozone neutralizing device such as a thin coating of activated carbon.

Figure 5:
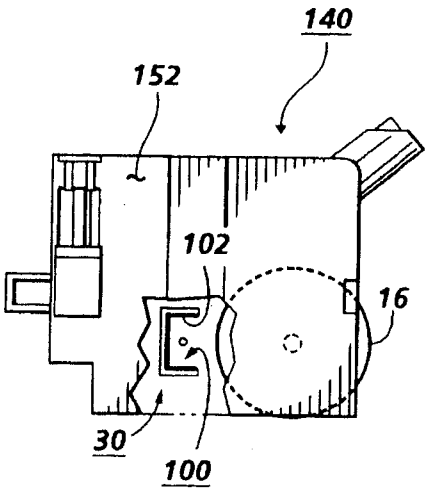
FIG. 5 is an end elevational view of the corona discharge device of FIG. 4.
Figure 4:
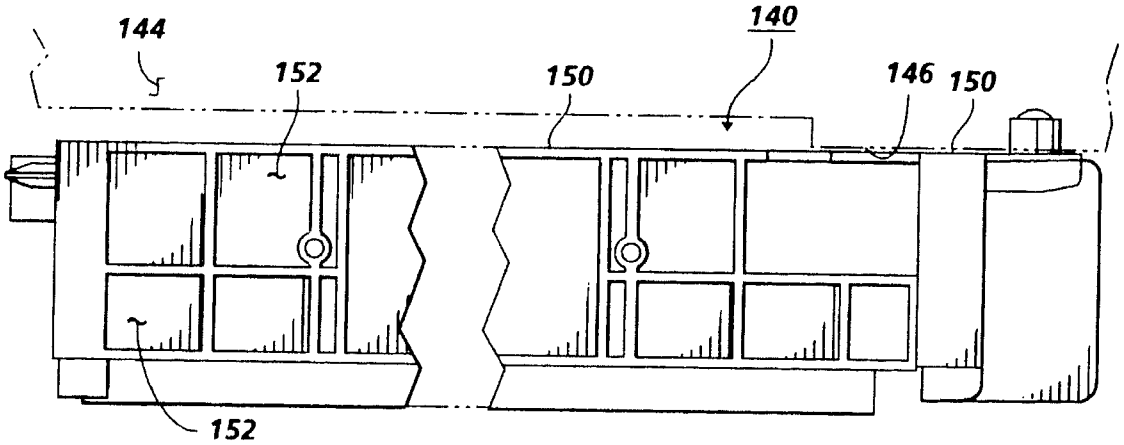
FIG. 4 is an elevational view of an embodiment of the corona discharge device according to the present invention installed onto a customer replaceable unit of an electrophotographic copy machine.

According to the present invention, and referring to FIGS. 4 and 5, a customer replaceable unit 140 is shown utilizing the corona generating device 30 having the replaceable ozone neutralizing strip 100 of the present invention. To aid in the easy servicing of a copy machine or printing machine (see FIG. 9), a customer replaceable unit 140 as shown in FIGS. 4 and 5 is typically designed to be easily removed from the copy machine. A typical example for the use of replacement of the customer replaceable unit 140 includes a support structure 144 of the copy machine which includes rails 146 to which outer faces 150 of the customer replaceable unit 140 matingly slide.

Customer replaceable units 140 are changed several times during the life of the copy machine. The customer replaceable units 140 are recently being remanufactured rather than being replaced with new customer replaceable units.

The customer replaceable unit 140 includes a housing or cartridge 152 to which several components, namely those components found to require replacement on a more frequent basis within a copy machine or printing machine, are mounted. Typically, the customer replaceable unit 140 includes the photoreceptor drum 16, the corona generating device 30 and other items determined to wear at a significant rate. For example, the customer replaceable unit 140 may also include the blade 74 of the cleaning station F. While the corona generating device 30 may requiring replacing during its remanufacture, frequently the corona generating device 30 may not require replacement while the neutralizing layer 102 usually requires replacement.

The removable layer 100 including the ozone neutralizing layer 102 of the corona generating device 30 is typically replaced during each remanufacture of a customer replaceable unit 140. Therefore, it is very important that the ozone neutralizing layer 102 be easily removed from the customer replaceable unit 140. The removable strip 100 including the neutralizing layer 102 serves to assist in the ease of removing and replacing the neutralizing layer 102 within the customer replaceable unit 140.

Figure 6:
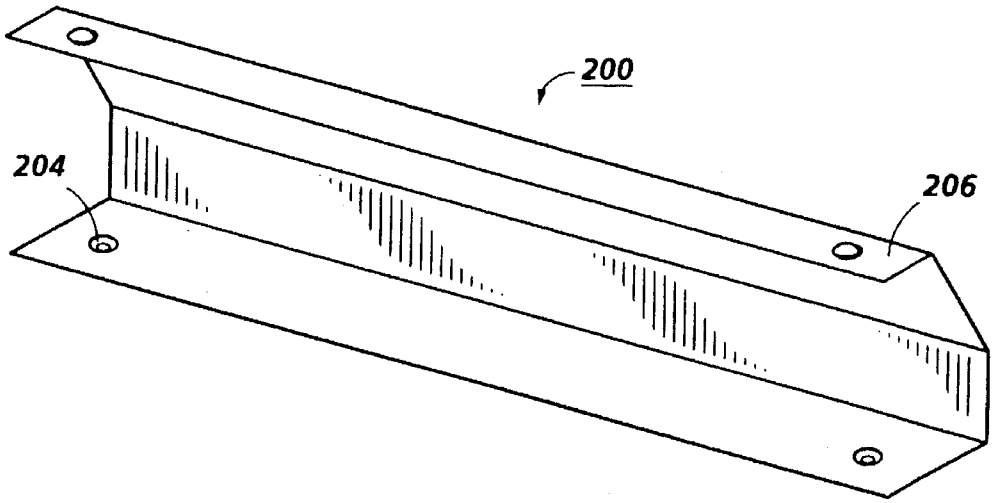
FIG. 6 is a perspective view of a removable ozone absorbing element according to the present invention.
Figure 7:
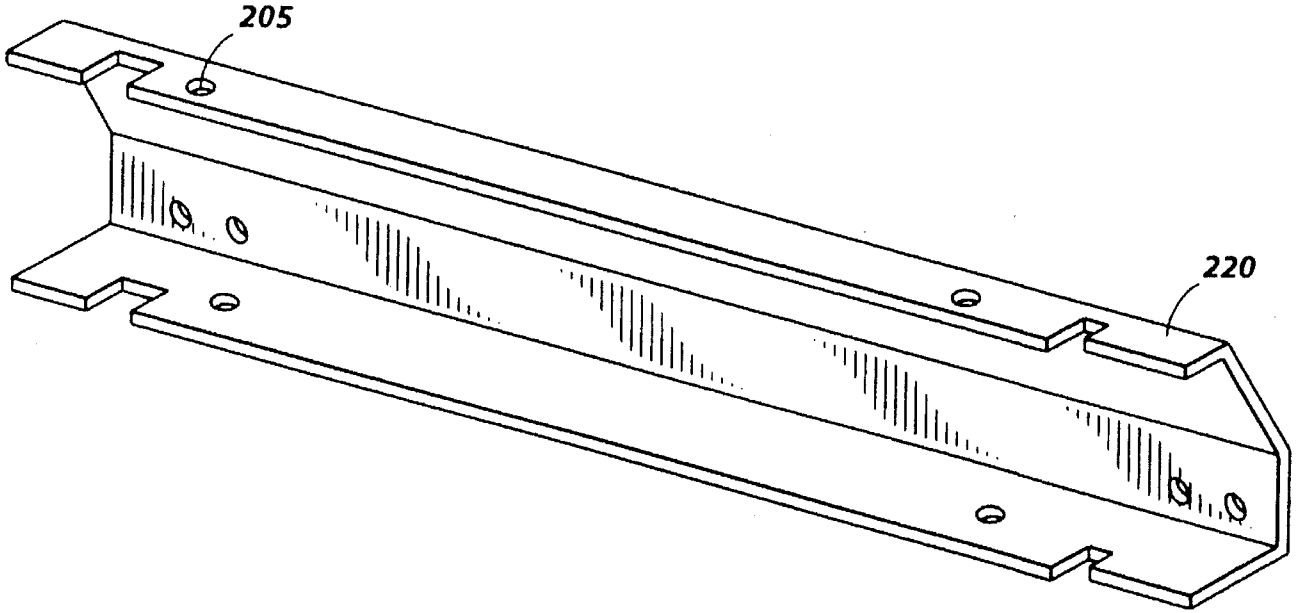
FIG. 7 is a perspective view of a corona discharge device shield for use with the ozone absorbing element of FIG. 6.
Figure 8:
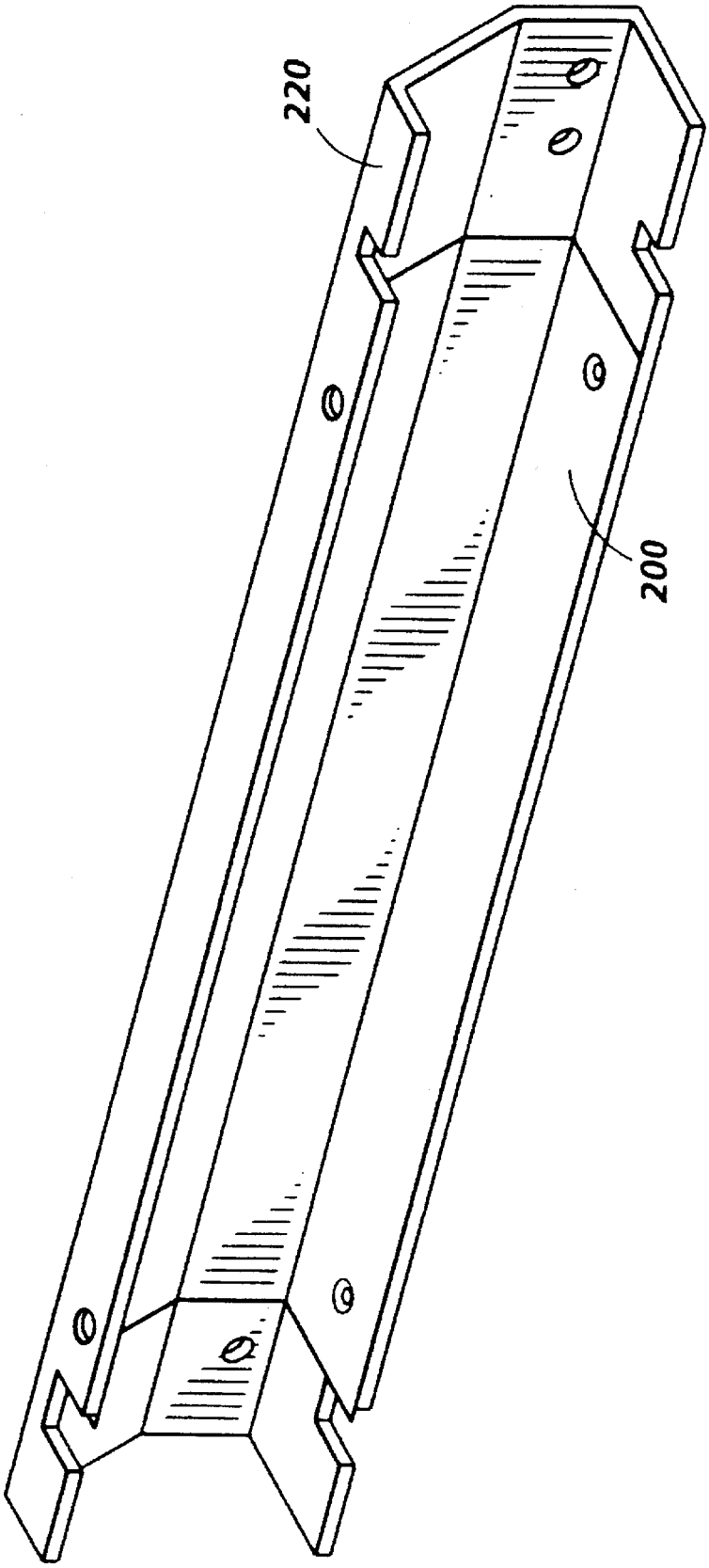
FIG. 8 is a perspective view of the ozone absorbing element of FIG. 6 installed in the corona discharge device shield of FIG. 7.

Referring now to FIGS. 6–8 an alternate configuration of a corotron shield is shown utilizing the removable ozone neutralizing layer of the present invention. Referring first to FIG. 6, a removable layer 200 is shown. The layer 200 is similar to layer 100 of FIG. 1, except the layer 200 includes a somewhat rigid substrate 206, rather than the conformable substrate 106 of FIG. 1.

Referring now to FIG. 7, a corotron shield 220 is shown. Shield 220 is similar to shield 120 of FIGS. 2 and 3, except the shield 220 has an asymmetrical shape. Note that the shield 220 of FIG. 7 and the layer 200 of FIG. 6 have mating shapes.

Referring now to FIG. 8, the removable ozone neutralizing layer 200 of FIG. 6 is shown installed into the shield of FIG. 7. The layer 200 may be secured to the shield 220 by any suitable means. The use of adhesives may be inexpensive and effective. If no adhesive were used, a first connector 204 in the form of, for example, a protrusion in the layer 200 could be snapped into second connector 205 in the form of, for example, a hole in the shield 220 or the layer 200 bent around the shield 220 to secure the layer thereto (not shown). For simplicity, the layer could serve also as the shield to form a self supporting structure.

It should be appreciated that by providing a copy machine with a corona generating device having an adjacent ozone neutralizing surface, excessive levels of ozone in a copy machine may be minimized.

By providing an ozone neutralizer surface that is removably secured, the corona generating device may be more simply and easily manufactured.

Also, by providing an ozone neutralizer surface that is removably secured to a corona generating device, the corona generating device may be more easily remanufactured, replacing only the worn neutralizer surface.

Further, by providing an ozone neutralizer surface that is removably secured to a corona generating device within a customer replaceable unit, the customer replaceable unit may be more easily remanufactured, replacing only the worn neutralizer surface.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A cartridge replaceable unit, comprising:

a housing;

a photoconductive member rotatably secured to said housing; and a corona generator secured to said housing and located adjacent said member, said corona generator including a support structure, an electrode mounted on said support structure, a securing member easily removably secured to said support structure, a substrate having a first surface thereof secured to said securing member, and an ozone neutralizing coating secured to a second surface of said substrate, said coating continuously surrounding at least one half of the periphery of said electrode, so that said substrate including said coating may be separated from said support structure and so that a new substrate including a new coating may be applied to said support structure, permitting the cartridge replaceable unit to be recycled.

2. A corona generator according to claim 1, wherein said support structure comprises a shield.

3. A corona generator according to claim 1, wherein said coating comprises a film of activated carbon.

4. A corona generator according to claim 3, wherein said coating further comprises a catalyst.

5. A printing machine of the type having a cartridge replaceable unit including a corona generator for charging a surface, the cartridge replaceable unit comprising:

a housing;

a photoconductive member rotatably secured to said housing; and a corona generator secured to said housing and located adjacent said member, said corona generator including a support structure, an electrode mounted on said support structure, a securing member easily removably secured to said support structure, a substrate having a first surface thereof secured to said securing member, and an ozone neutralizing coating secured to a second surface of said substrate, said coating continuously surrounding at least one half of the periphery of said electrode, so that said substrate including said coating may be separated from said support structure and so that a new substrate including a new coating may be applied to said support structure, permitting the cartridge replaceable unit to be recycled.

6. A printing machine according to claim 5, wherein said support structure comprises a shield.

7. A printing machine according to claim 5, wherein said coating comprises a film of activated carbon.

8. A printing machine according to claim 7, wherein said coating further comprises a catalyst.

* * * * *